US005743808A

United States Patent [19]

Barth

[11] Patent Number: 5,743,808

[45] Date of Patent: Apr. 28, 1998

[54] BASEBALL THROWING TRAINER

[76] Inventor: Joseph Barth, 6 Bicentennial Ct., Erial, N.J. 08081

[21] Appl. No.: 621,365

[22] Filed: Mar. 25, 1996

[51] Int. Cl.[6] ..... A63B 69/36

[52] U.S. Cl. ..... 473/280

[58] Field of Search ..... 273/58 C, 26 R, 273/58 K, 199; 473/200, 280, 596, 597, 615

[56] References Cited

U.S. PATENT DOCUMENTS

| | | | |
|---|---|---|---|
| 3,184,234 | 5/1965 | Struble | 473/28 D |
| 3,918,720 | 11/1975 | Gordos | 473/200 |
| 4,593,901 | 6/1986 | Moore | 273/58 C |
| 5,409,217 | 4/1995 | Bobby | 273/73 D |
| 5,595,546 | 1/1997 | Masters | 473/280 |

*Primary Examiner*—Theatrice Brown

*Attorney, Agent, or Firm*—Donald C. Simpson

[57] ABSTRACT

A pitching/throwing device comprising a first ball, a second ball, and connector for connecting the first and second balls to each other. In the preferred embodiment, the balls are standard baseballs and the connector comprises a dowel screw. During use, the student holds the device by either ball and grips the ball in the appropriate manner for the pitch being thrown. Then, depending on the pitch to be thrown, the student flips or throws the ball to another while trying to impart the appropriate rotation to the ball. Because of the changed center of gravity resulting from the interconnection of the two balls, the act of imparting the desired rotation is made easier and the rotation of the ball is readily observable. This process is performed in several steps to first focus on the appropriate wrist/hand action and then to focus on the full arm delivery. The device can also be used by the student alone, by flipping the ball into the air while imparting the appropriate rotation to the ball.

6 Claims, 4 Drawing Sheets

BASEBALL THROWING TRAINER

BACKGROUND OF THE INVENTION

The present invention relates to training devices for baseball players. More particularly, the present invention relates to a device that can be used by players of any field position to teach them proper throwing techniques; further, the device of the present invention is particularly useful in teaching proper technique for pitching fastballs, curve balls, change-ups, and other variations on these pitches.

Proper throwing, particularly when pitching, requires the person throwing the ball to impart a particular spin or rotation to the ball upon release of the ball from the pitching hand. The exception to this is the knuckleball which is deliberately delivered in such a manner that the spin or rotation is minimized or non-existent. A fastball is thrown such that, as the ball moves towards the plate, the top of the ball rotates towards the release hand of the pitcher and away from the plate; a curve ball is thrown so that the top of the ball rotates away from the release hand of the pitcher and towards the plate. Each pitch requires a particular arm angle and/or wrist motion to deliver the ball to the plate in the desired manner.

Various techniques exist for teaching proper throwing/pitching technique. Elongated cylindrical cans, such as tennis ball cans, have been used to illustrate the proper technique for holding and releasing the ball. The can is held between the palm of the pitching hand and the biceps of the pitching arm to simulate the relative positioning of the palm, biceps, and forearm. Obviously, this method does not acclimate the student to the actual feeling felt when throwing a ball.

U.S. Pat. No. 3,152,803 to Sain, Jr. teaches a baseball pitching training device which comprises a standard baseball having a tube inserted through the ball, and a generally cylindrical-shaped handle with a spindle passing through the tube so that the handle/spindle assembly is fixedly attached to the ball. The user of this device holds the ball in the pitching hand and the handle in the free hand and imparts the proper rotation to the ball with the pitching hand. By observing the movement of the handle, the student can determine whether the proper rotation for a particular pitch is being imparted to the ball. One major drawback of this device is that the ball is never actually thrown; instead, the user "throws" a "simulated pitch" and observes what the proper rotation should be, and then tries to recreate the action with a regular baseball. Further, if a user tried to throw the device to another, the handle sticking out of the ball could injure anyone trying to catch the ball.

U.S. Pat. No. 4,930,773 to Outlaw teaches a curve ball pitching training device in which a truncated cone-shaped chamber resembling a deep cup or glass is fixedly attached to a standard baseball. The narrow end of the chamber is attached to the baseball, and the wider open mouth end receives a free baseball. Because of the broad-to-narrow shape of the chamber, the free baseball, when inserted, is secured snugly to the side walls of the chamber. The user then proceeds through a throwing motion and attempts to impart the proper motion for a curve ball to the ball held in his or her hand. If the proper motion is imparted to the ball being held by the pitcher, the free ball will be discharged from the chamber. While this device may allow the pitcher to "feel" the proper motion needed to throw a curve ball, the ball being held in the pitcher's hand is never released, so the student cannot experience the "feel" that should exist when the pitch is actually thrown. Further, this device will not assist in teaching the art of throwing a fastball or change-up because the rotation in a direction opposite to that of a curve ball will not result in the free ball being discharged from the chamber.

SUMMARY OF THE INVENTION

The present invention provides an apparatus or device that can be utilized to teach and practice the various techniques for throwing a baseball either as a pitch or as a throw from the field. The device is actually thrown so that the entire throwing motion, from the grip to the delivery to the release, is experienced by the student. Since it uses standard size baseballs, to the thrower the grip on the ball actually feels the same as a regular baseball. In addition, the device can be easily caught by a partner.

The pitching/throwing device of the present invention comprises a first ball, a second ball, and connection means for connecting said first and said second balls to each other. In the preferred embodiment, the balls are standard baseballs and the connection means comprises a dowel screw.

During use, the student holds the device by either ball and grips the ball in the appropriate manner for the pitch being thrown. Then, depending on the pitch to be thrown, the student flips or throws the ball to another while trying to impart the appropriate rotation to the ball. Because of the changed center of gravity resulting from the interconnection of the two balls, the act of imparting the desired rotation is made easier and the rotation of the ball is readily observable. This process is performed in several steps to first focus on the appropriate wrist/hand action and then to focus on the full arm delivery. The device can also be used by the student alone, by flipping the ball into the air while imparting the appropriate rotation to the ball.

DETAILED DESCRIPTION OF THE PREFERRED EMBODIMENT

Figure 1:
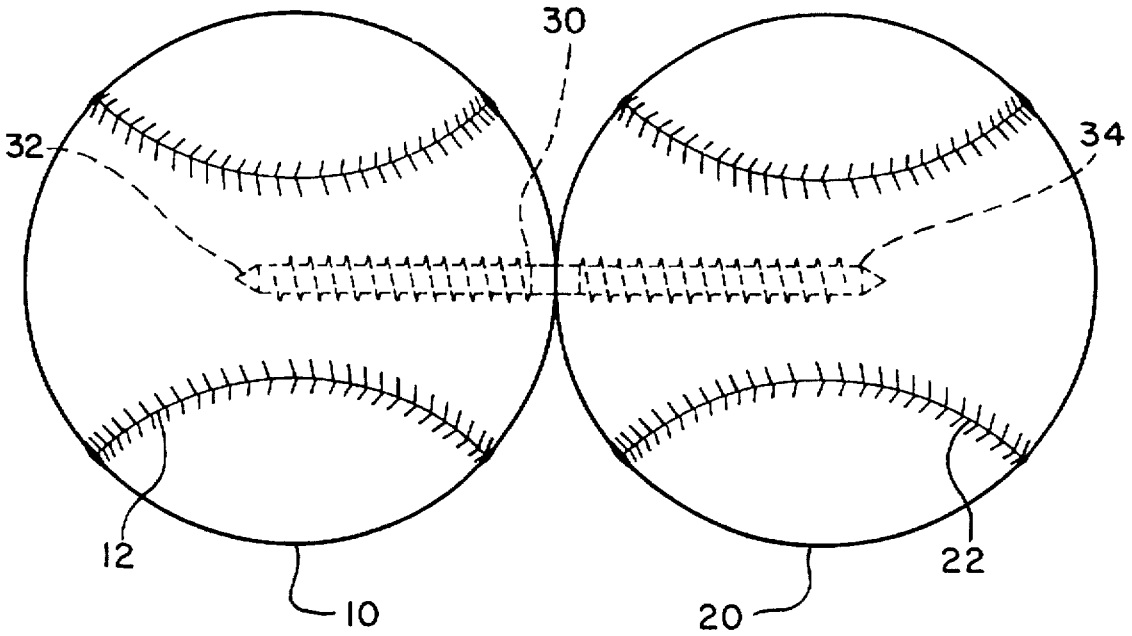
FIG. 1 is a side perspective view of the device of the present invention, showing the connecting means in phantom lines.

Referring to FIG. 1, the device of the present invention comprises a first standard sized baseball 10 having a continuous seam 12 to hold the cover of the ball to the core of the ball; a second standard sized baseball 20 having a continuous seam 22 to hold the cover of the ball to the core; and a connecting means 30, having threaded ends 32 and 34, to hold the two balls 10 and 20 together. The cover of a conventional baseball comprises two generally "8-shaped" sections sewn together onto the core.

In the preferred embodiment, the connecting means 30 comprises a dowel screw, which has threading on both ends so that one ball can be screwed onto threaded portion 32 of the connecting means 30 and the other ball can be screwed onto the other threaded portion 34 of the connecting means 30. Although not necessary, the threaded portions 32 and 34 can be coated with an uncured epoxy glue or other suitable adhesive means prior to threading the balls onto the connecting means 30 and permitted to cure once the balls are in place. The glue keeps the balls from being rotated back off of the connecting means 30. Optimally, the length of the dowel screw should be such that, when the two balls are screwed completely onto the dowel screw so that the edges of the two balls meet, the end of threaded portion 32 extends to, or slightly beyond, the center of the ball 10 and the end of threaded portion 34 extends to, or slightly beyond, the center of ball 20. Pilot holes should be drilled radially inward towards and/or through the center of the balls, to a depth of approximately one-half to three-quarters of the diameter of ball, before the balls are screwed onto the dowel screw.

Figure 7:
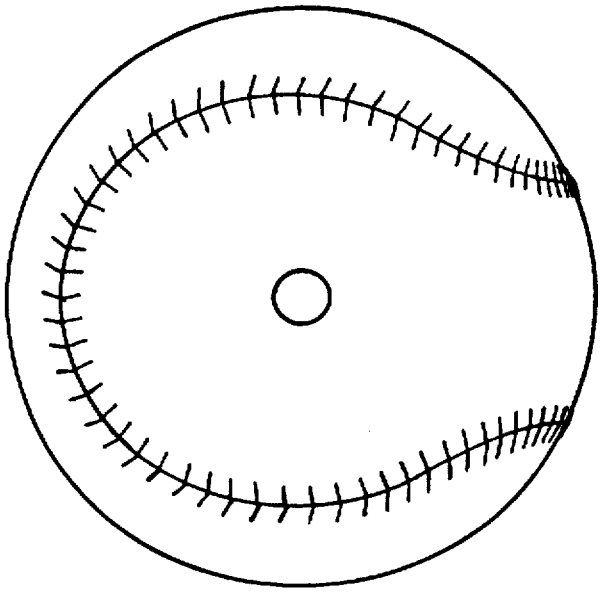
FIG. 7 is a side view of one of the balls of the present invention illustrating the preferred position of the connection means relative to the seams of the ball.

When using a seamed ball, such as a standard baseball, the preferred position for the dowel screw to be inserted is in approximately the center of one of the "circles" that define the "8-shape" of one of the cover pieces, as shown in FIG. 7. Pitching, in particular, can require the pitcher to position the fingers of the pitching hand in specific locations relative to the seams. By inserting the dowel screw at this location in each of the balls, the seams are lined up for optimum finger positioning by the pitcher.

USE OF THE TRAINER

The use of this invention is described with regard to a right-handed thrower/pitcher. It is understood that it can also be used for a left-handed thrower/pitcher.

Figure 2:
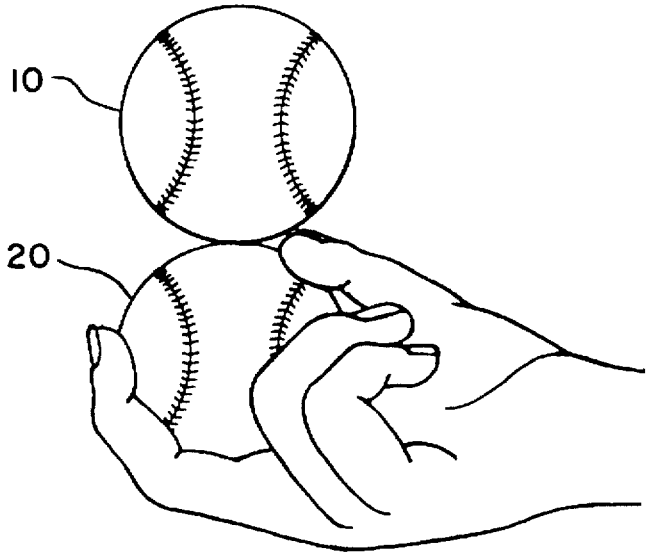
FIG. 2 is a side perspective view of the proper way to hold the de vice of the present invention for a fastball drill.

The present invention is used for exercise and warm-up, in addition to being used to work on throwing technique. The usual procedure would be for a user to begin by loosening up with the trainer. For fastball drills, the user can start in a sitting position. The player lays his forearm on his or her leg, palm-up, so that the elbow is on the thigh and the hand is situated on the knee, palm up. For purposes of this explanation, when starting an exercise, ball 10 will be the top ball and ball 20 will be the bottom ball. The student should hold the bottom ball 20 in the standard fastball grip, with the tip of the thumb positioned near the area where the two balls are connected and with the index and middle finger situated across the seams, such that the top ball 10 is "pointed" directly upward as shown in FIG. 2. The student then flips the device upward by quickly pulling the wrist and fingers towards his or her body, so that the two fingers across the seams are pulled "through" the ball. If properly executed, this causes the device to flip, end over end, such that the bottom ball 20 rotates towards the user and the top ball 10 rotates away from the user. This "fingers through the ball" motion is the same motion that is used for throwing the fastball. This flipping motion should be repeated as often as desired. In addition to giving the student a feel for the "fingers through the ball" technique, this exercise also loosens up and develops the muscles used when throwing a fastball.

Figure 3:
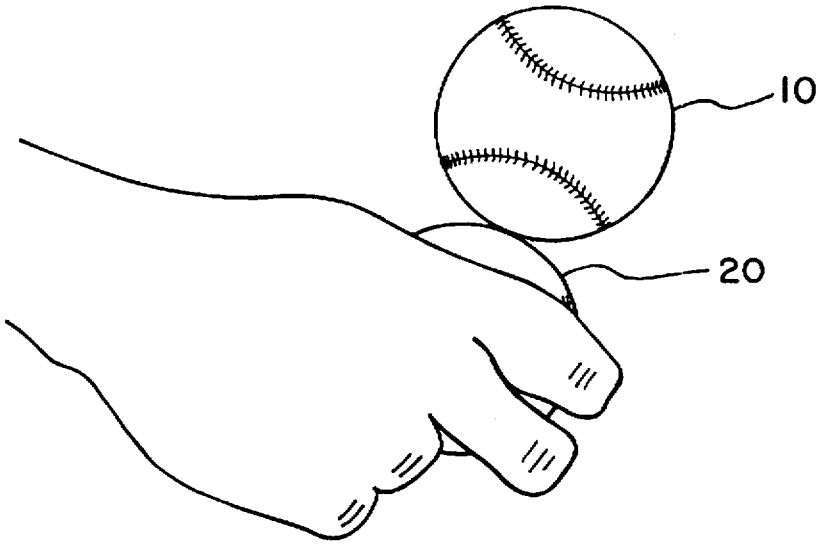
FIG. 3 is a perspective view of the proper way to hold the device of the present invention for a curveball drill.
Figure 4:
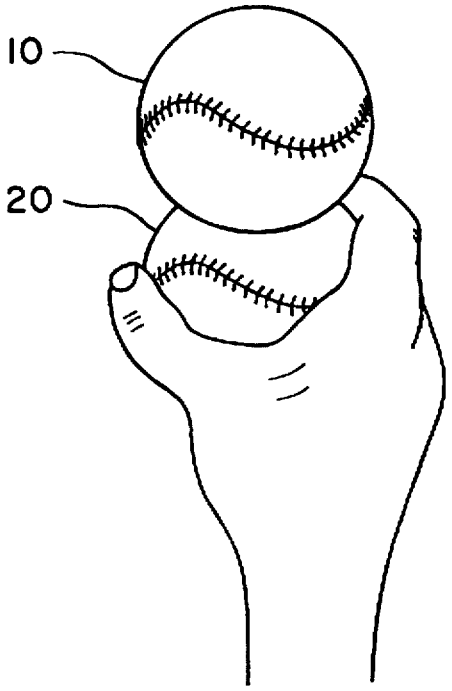
FIG. 4 is another perspective view of the proper way to hold the device of the present invention for a curveball drill.
Figure 5:
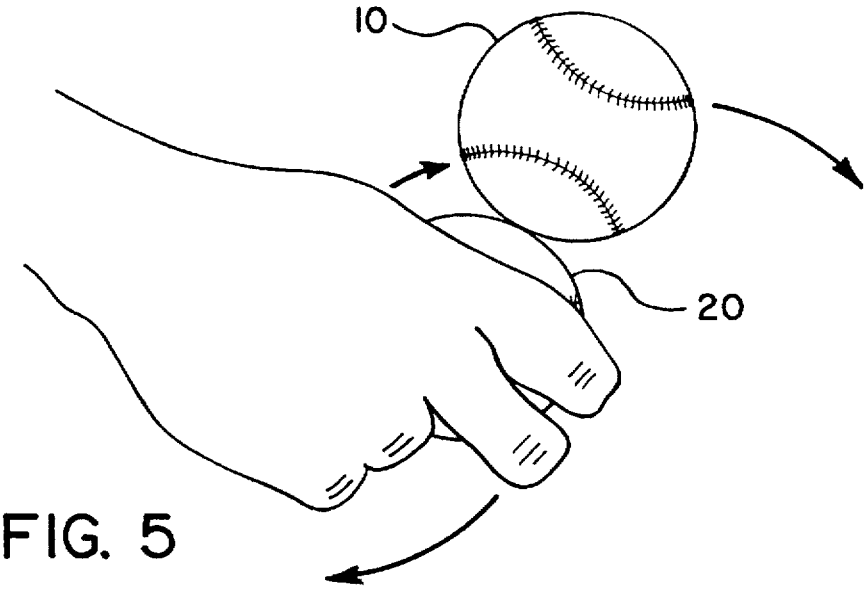
FIG. 5 is a perspective view of the device of the present invention being held in a curveball grip, with arrows demonstrating the rotation to be imparted to the ball when doing a curveball drill.

A curve ball exercise is similar in that the user again places his or her arm on his or her leg, palm-up, so that the elbow is on the thigh and the hand is situated on the knee, palm up. This time, the student grips the ball using a standard curve ball grip, which has the student grip the ball so that the index finger goes along a seam as shown in FIG. 3 and FIG. 4. The object of the curve ball grip is to cause "four seam rotation" in which, from the perspective of the batter, the ball spins so that the batter would see four different lengths of the seam with each rotation of the ball if the ball were moving slow enough to be able to perceive the seams. Once again, the top ball 10 is "pointed" directly upward as shown in FIG. 3; in this position, the hand is almost in a "handshake" position with the bottom ball 20. The student then flips the device upward into the air by "pulling" the fingers towards the body while rotating the thumb away from the body as shown by the arrows in FIG. 5. This causes the device to rotate so that the lower ball 20 moves towards the body of the student while the top ball 10 spins away from the body of the student. This exercise gives the user a general feel for the motion used when throwing a curve ball and also loosens up and develops the muscles needed to effectively throw the curve ball.

Figure 6:
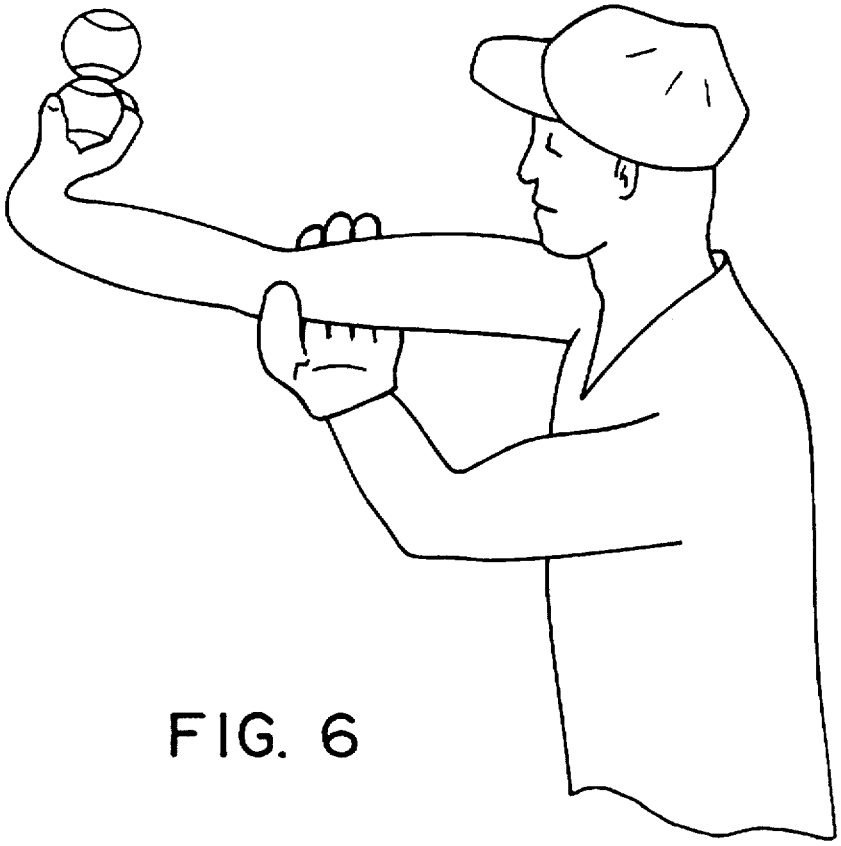
FIG. 6 is a perspective view of a student demonstrating the proper arm positioning for the "elbow in glove" exercise.

Throwing exercises are utilized to help the student practice the motion used in throwing. The first set of exercises will be called the "elbow in glove" exercises because they are performed with the elbow of the pitching arm resting in the opened pocket of the baseball glove worn on the glove hand. For the "elbow in glove" fastball throwing exercise, the student and a partner stand relatively close together, perhaps 10 feet apart. The student then grips the bottom ball 20 using the previously described fastball grip, thumb near the connection of the two balls and the index finger and middle finger across the seams as shown in FIG. 2. The student places the open glove, palm up, under the throwing elbow, as shown in FIG. 6. From this position, using only the wrist and fingers, the student flips the trainer to the partner. The top ball 10 should be pointed towards the ceiling, and as the student flips the device, the index and middle fingers should travel "through" the ball as described previously. This motion will cause the bottom ball 20 to spin out away from the student and the top ball 10 to spin back towards the student. This motion should be repeated over and over so that the "finger through the ball" motion becomes routine to the student. The student will use the same motion when pitching in full stride.

Once the student has mastered the "elbow in glove" flip, the student can move back to a distance of about 20 feet from his partner. Facing the partner, shoulders squared to the partner, and holding the ball in the fastball grip, the student should raise the device, gripping the bottom ball 20 with the top ball 10 pointed directly upward, so that the arm is raised and slightly behind the student. From this position, the student should bring the arm forward and almost "push" the fingers through the ball, imparting the same motion to the device as described above, so that the bottom ball 20 goes forward and away from the student and the top ball 10 comes back toward the student. Repeating this motion over and over will further develop the arm strength needed to properly throw the fastball and will familiarize the student with the motion needed to properly throw the ball. When the student throws a regular ball at a regulation pitching distance and using a complete windup and delivery, the student should duplicate the same motion used to spin the ball, and be able to throw a fastball correctly.

For the curve ball throwing exercise, the ball is gripped using the curve ball grip as discussed previously. The bottom ball 20 is gripped by the student and the top ball 10 is raised directly upward. With the pitching elbow placed in the glove as previously described, the student flips the device to the partner about ten feet away, "pulling" the bottom ball 20 towards the students body and flipping the top ball 10 away from the students body. After repeating this exercise until comfortable with the motion, the student and partner separate to a distance of about twenty feet. This time, the student should stand with the shoulder of his or her glove arm facing the partner and the shoulder of his or her throwing arm away from the partner. On a baseball diamond, this position would put a right handed pitcher facing third base in the "stretch" position.

The student then raises the device up so that his or her arm is in the air holding the bottom ball 20 with a curve ball grip, with the top ball 10 pointing directly upward. As the arm is brought around to release the ball, the student imparts the same motion described above to the device to cause the top ball 10 to spin towards the partner and the bottom ball 20 to be "pulled" towards the student. This motion should be repeated until the student is comfortable with it. The student can try duplicating the same motion with a full windup and delivery, using a regulation ball and at regulation distance.

This same techniques can be used for teaching almost any desired pitch. For example, the change-up is practiced in the same manner as the fastball, but the grip is changed so that the middle finger and the ring finger cross the seams. Obviously other pitches can be taught using the present invention utilizing the appropriate grip for the appropriate pitch, and it is not considered necessary to describe each of the many variations of pitches and rotative ball movements that may be demonstrated and practiced with this invention.

In addition to enabling the user to do conditioning exercises and to practice throwing the ball using the proper motion, the present invention can also be used to assist in the "breaking in" of a new glove. It is quite common for a player to repeatedly "work" a new glove with a ball until the glove is softened up to a point where it can be used in game conditions. By using the device of the present invention for breaking in the glove, the time needed to break the glove in is reduced because of the added weight and size of the device.

Although preferred embodiments of this invention have been described and shown herein, it is to be understood that the invention is not limited in scope to the details of construction and arrangement of parts, except within the scope of the appended claims.

What I claim is:

1. A device for training a pitcher to impart appropriate rotation and hand motion to a ball having a cover surrounding a ball core, wherein said cover consists of two generally 8-shaped sections sewn together in a continuous seam holding said cover to the core, said device consisting of:

first and second identical balls;

a second ball of said type; and connection for rigidly connecting said first and said second balls to each other, said first and said second balls being in contact with each other when so connected.

2. A device as set forth in claim 1, wherein said connection means comprises a dowel screw.

3. A method for practicing the proper technique for pitching, comprising the steps of:

providing a device having a first ball connected to a second ball, each of said balls having a cover surrounding the ball core wherein said cover consists of two generally 8-shaped sections sewn together in a continuous seam holding said cover to the core;

gripping one of said balls with a pitching hand; and emulating the wrist and finger movements associated with the pitching of one of such balls so as to cause the device to rotate in a manner consistent with the proper wrist and finger movement for pitching such ball.

4. A method as set forth in claim 3 wherein said first ball and said second ball each comprise a standard baseball.

5. A device for training a pitcher of a baseball to impart the appropriate rotation and hand motion to the baseball, consisting of:

a first standard baseball;

a second standard baseball; and connection means for rigidly connecting said first and said second baseballs to each other, said first and said second baseballs being in contact with each other when so connected.

6. A device as set forth in claim 5, wherein said connection means comprises a dowel screw.

* * * * *